US006223630B1

(12) United States Patent
Stanton

(10) Patent No.: US 6,223,630 B1
(45) Date of Patent: May 1, 2001

(54) OPEN END RATCHET WRENCH

(76) Inventor: John L. Stanton, 1550 Hazelwood Dr., Clarksville, TN (US) 37043

( * ) Notice: Subject to any disclaimer, the term of this patent is extended or adjusted under 35 U.S.C. 154(b) by 0 days.

(21) Appl. No.: 09/036,349

(22) Filed: Mar. 6, 1998

(51) Int. Cl.[7] ..... B25B 13/28
(52) U.S. Cl. ..... 81/111; 81/90.1
(58) Field of Search ..... 81/179, 90.1, 91.1, 81/91.2, 91.3, 92, 94, 111, 126

(56) References Cited

U.S. PATENT DOCUMENTS

| | | | | |
|---|---|---|---|---|
| 1,406,467 | | 2/1922 | Matthey . | |
| 1,489,458 | | 4/1924 | Petersen . | |
| 1,732,000 | * | 10/1929 | Colognori | 81/111 |
| 2,047,548 | * | 7/1936 | Colognori et al. | 81/111 |
| 2,426,191 | | 8/1947 | Feiring . | |
| 2,712,259 | | 7/1955 | Cowell . | |
| 2,795,160 | | 6/1957 | Blasdell . | |
| 3,921,474 | | 11/1975 | Dyck et al. . | |
| 3,927,582 | | 12/1975 | Hertelendy et al. . | |
| 4,204,440 | | 5/1980 | Del Prete et al. . | |
| 4,488,459 | | 12/1984 | Bailey et al. . | |
| 4,574,665 | | 3/1986 | Blachly . | |
| 4,644,830 | | 2/1987 | Bailey et al. . | |
| 4,718,315 | | 1/1988 | Nitschmann . | |
| 4,787,277 | | 11/1988 | Myers . | |
| 4,848,193 | | 7/1989 | Wylie, III . | |
| 4,926,720 | | 5/1990 | Srzanna . | |
| 5,148,725 | | 9/1992 | Botha . | |
| 5,427,004 | * | 6/1995 | Monaco | 81/91.3 |
| 5,456,143 | | 10/1995 | Stanton . | |
| 5,533,428 | | 7/1996 | Pradelski . | |
| 5,553,520 | | 9/1996 | Jacobs . | |
| 5,582,082 | | 12/1996 | Gajo . | |
| 5,829,327 | * | 11/1998 | Stanton | 81/94 |

FOREIGN PATENT DOCUMENTS 568058 12/1923 (FR) .

OTHER PUBLICATIONS

*Griot's Garage,* "Ratchet Flare Nut Wrench," p. 7, Spring, 1994.

* cited by examiner

*Primary Examiner*—Eileen P. Morgan
*Assistant Examiner*—Joni B. Danganan
(74) *Attorney, Agent, or Firm*—Fish & Richardson P.C.

(57) ABSTRACT

A wrench has a pair of jaws that are disposed on a handle and are spaced to define an opening for a workpiece. A pair of plates, each of which includes a workpiece engaging surface are mounted on the jaws for selective movement between first and second positions. In the first position, the plates are immobile with respect to each other so that rotation of the handle in a first direction causes the plates to grasp the workpiece between the engaging surfaces and turn the workpiece in the first direction. In the second position, a first one of the plates is pivotable with respect to a second one of the plates so that rotation of the handle in a second, opposite direction causes pivoting of the first plate and allows the engaging surfaces to slide over the workpiece, thereby allowing the workpiece to remain stationary. Thus, the wrench tightens (or loosens) the workpiece when rotated in the first direction, and slips over the workpiece in a "ratcheting" manner when rotated in the second, opposite direction.

21 Claims, 3 Drawing Sheets

OPEN END RATCHET WRENCH

BACKGROUND

This invention relates to ratchet wrenches, and more particularly to open-end ratchet wrenches that can be placed on a workpiece from the side.

There are many occasions when it is desirable to apply torque to a workpiece (such as nuts, bolts, and in-line hydraulic fittings) in order to, for example, rotate the workpiece with respect to a threaded member. Two well known tools for rotating workpieces are ratchet wrenches and open-end crescent wrenches. Ratchet wrenches are typically close-ended devices that completely encircle the workpiece and are thus installed on the workpiece from the top (or bottom, depending upon the orientation of the workpiece). By contrast, open-end wrenches can be installed from the side of the workpiece.

Open-end wrenches are particularly useful in small spaces where there may only be sufficient room to install the wrench from the side. Moreover, in confined spaces, there is often insufficient space to accommodate the ratchet mechanism of typical close-ended ratchet wrenches. In addition, open-end wrenches are a must for tightening/loosening in-line fittings of hydraulic or fuel lines, which can only receive a wrench from the side.

Typical open-end crescent wrenches lack a ratchet mechanism. As a result, during a tightening or loosening operation, the wrench must be removed from the workpiece after it has rotated the workpiece a relatively small amount (such as 30 degrees), and then replaced thereon at a different angle for continued rotation. This procedure is repeated (often many times) until the workpiece is completely tightened or loosened.

Open-end ratchet wrenches that resemble typical crescent wrenches have been developed for confined and in-line fitting applications. Some open-end ratchet wrenches employ numerous spring-loaded rollers, cams, or pawls for engaging the workpiece; others use an insert shaped to fit over the workpiece and engage an internal ratchet mechanism. Some of these wrenches encircle the workpiece to such an extent that, even though the wrenches have open ends, they must actually be installed vertically from above or below the workpiece.

Another open-end ratchet wrench, described in my U.S. Pat. No. 5,456,143, includes a pair of elongated plates that are pivotally mounted to a pair of spaced jaws on the wrench handle. A spring mounted on the handle engages the plates and biases them toward each other so that the plates grasp and turn the workpiece when the handle is rotated in a driving direction. The spring bias is overcome when the handle is turned in the opposite direction, allowing both plates to pivot on the jaws and slide over the faces of the workpiece in a ratcheting manner.

SUMMARY

This invention features, in a general aspect, a wrench having a pair of jaws disposed on a handle and spaced to define an opening for a workpiece, and a pair of plates each of which includes a workpiece engaging surface adjacent the opening; the plates are mounted on the jaws for selective movement between: a) a first position in which the plates are immobile with respect to each other so that rotation of the handle in a first direction causes the plates to grasp the workpiece between the engaging surfaces and turn the workpiece in the first direction, and b) and a second position in which a first one of the plates is pivotable with respect to a second one of the plates so that rotation of the handle in a second, opposite direction causes pivoting of the first plate and allows the engaging surfaces to slide over the workpiece, thereby allowing the workpiece to remain stationary. Thus, the wrench tightens (or loosens) the workpiece when rotated in the first direction, and slips over the workpiece in a "ratcheting" manner when rotated in the second, opposite direction.

The invention unites features of an open end wrench and a ratchet wrench in a wrench that is rugged and simple to make. The wrench has a minimal number of moving parts and thus is much easier to manufacture (and repair) than wrenches which use many individual pawls or rollers to provide ratcheting. In preferred embodiments, the plates each engage the workpiece over a relatively large surface area, thereby maximizing torque transmission and minimizing contact stresses imposed on the wrench and the workpiece. This reduces the risk of damage to the wrench and the workpiece.

The spacing between the jaws and the configuration of the elongated plates permit the plates to operate the workpiece while engaging only four faces of the workpiece and encircling the workpiece through an arc of only 240 degrees. As a result, the wrench can easily be inserted onto and removed from the workpiece from the side for ease of use in cramped spaces. In preferred embodiments, the ratcheting operation is assisted by a spring which biases one of the plates toward the opening, which makes turning the workpiece fast and easy while requiring no clearance behind the workpiece.

Preferred embodiments may include one or more of the following additional features.

The plates are mounted for the selective movement in response to rotation of the handle. No separate locking or unlocking mechanism is needed to change the operating state of the wrench. For example, after turning the workpiece in the first direction, the wrench is simply rotated in the opposite direction to move the plates to the second position for ratcheting.

The first plate is mounted to a first one of the jaws so that the distal end of the plate is immobile in the first position, and is pivotable with respect to the second plate in the second position. A distal pin on the distal end of the first plate is received by a slot disposed in a distal region of the first jaw. The distal pin is disposed in a first portion of the distal slot when the plate is in the first position, and is disposed in a second portion of the distal slot when the plate is in the second position.

The first portion of the distal slot is oriented so that the engagement of the distal pin therein holds the distal end of the first plate immobile with respect to the second plate when the wrench is rotated in the first direction, and the second portion of the distal slot is oriented to allow the distal end of the first plate to pivot with respect to the second plate when the wrench is rotated in the second direction.

A proximal pin on the proximal end of the first plate is received by a slot disposed in a proximal region of the first jaw. This proximal slot and the first portion of the distal slot are oriented (preferably along a common arc of curvature) to allow the selective movement of the first plate between the first and second positions. The center of the common arc of curvature is disposed in the opening. The second portion of the distal slot is arranged transversely to the arc of curvature.

The proximal pin is also mounted to the proximal end of the second plate. A distal pin at a distal end of the second plate is received by a slot disposed in a distal region of the second jaw. This distal slot is, with the proximal slot, oriented to allow the selective movement of the second plate between the first and second positions.

The plates and the spring are arranged so that turning the wrench over with respect to the workpiece reverses operation of the wrench in the first and second directions. That is, with the wrench turned over, the wrench tightens or loosens the workpiece when rotated in the second direction, and produces the ratcheting action when rotated in the first direction.

The plates are identically configured. This significantly simplifies manufacture and, along with the manner in which the plates are movably mounted to the jaws renders the wrench easily scalable in size. Each plate preferably has a plurality of the engaging surfaces, and each surface is elongated so as to engage a face of the workpiece over a major portion of a length of the face. The engaging surfaces are flat. The engaging surfaces are arranged to define an angle therebetween equal to an angle between adjacent faces of the workpiece.

Other features and advantages of the invention will become apparent from the following detailed description, and from the claims.

DRAWINGS

DETAILED DESCRIPTION

The wrenches of this invention are similar to those of my U.S. Pat. No. 5,456,143 ("the '143 patent") and my copending U.S. patent application Ser. No. 08/728,627 ("the '627 application"), both of which are entitled "Open End Ratchet Wrench" and are incorporated herein by reference. The wrenches of the present invention have many of the advantages of the wrenches of the '143 patent and the '627 application, plus additional advantages that have been discussed or that will become apparent.

Figure 2:
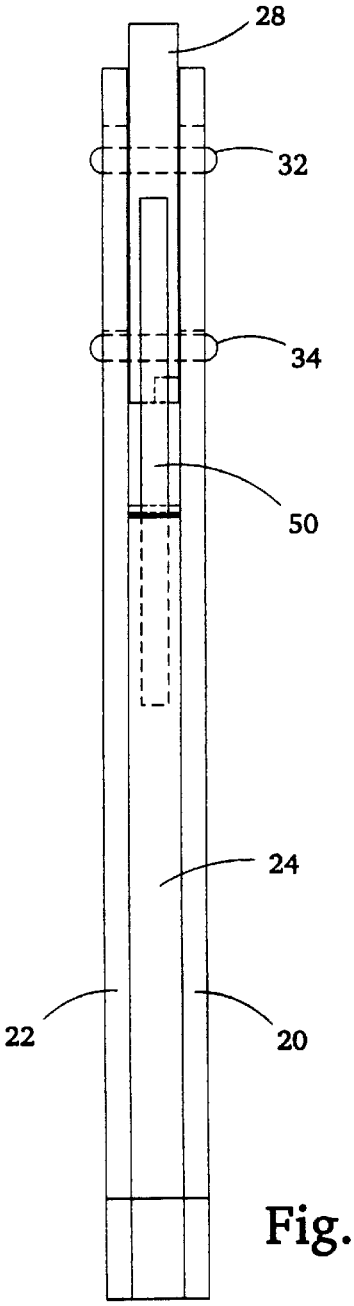
FIG. 2 is a side view of the wrench of FIG. 1.
Figure 1:
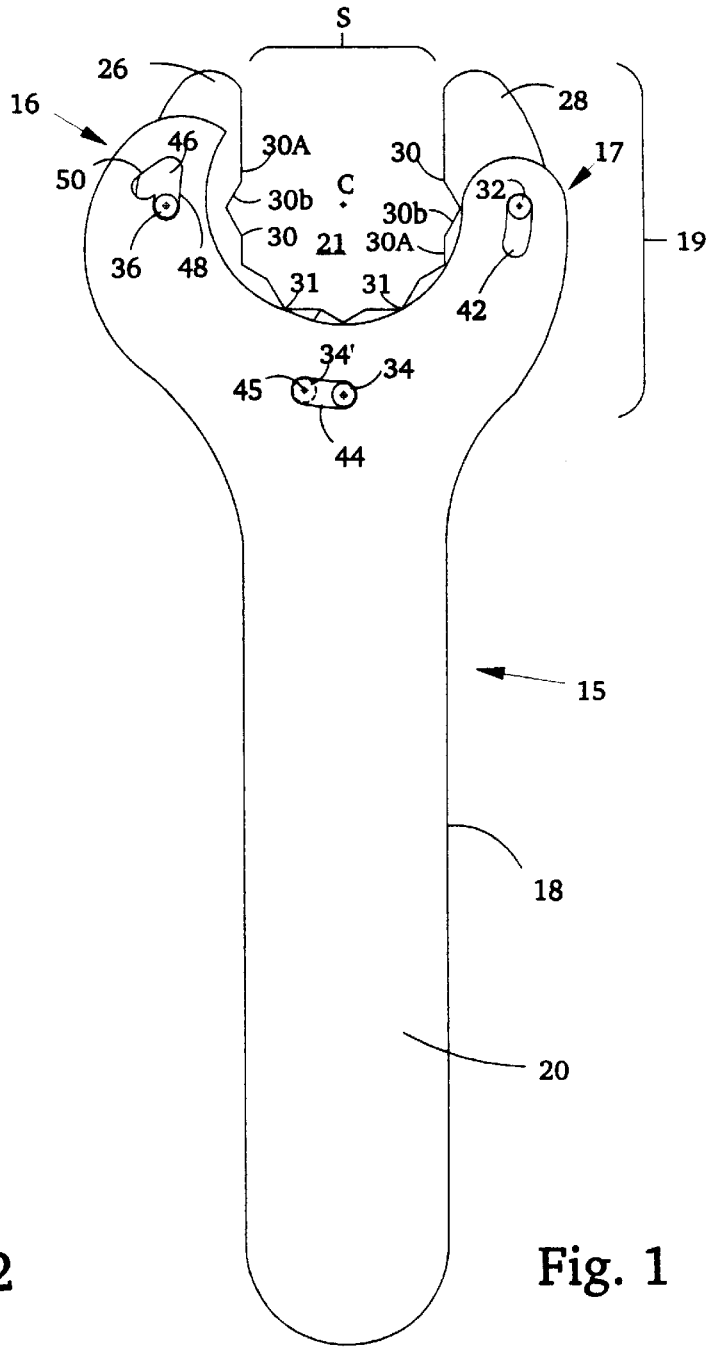
FIG. 1 is a top plan view of an open-end ratchet wrench.
Figure 3:
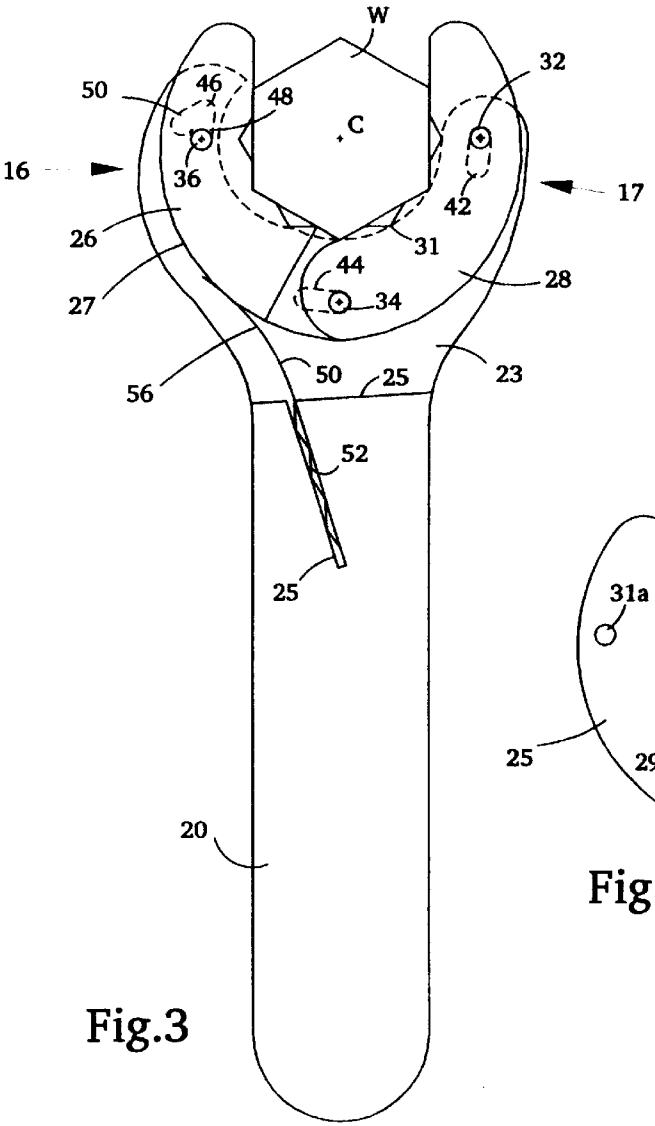
FIG. 3 shows the wrench of FIG. 1 with the front face plate removed to illustrate a pair of elongated plates that are pivotally mounted on the wrench.

Referring to FIGS. 1–3, open-end ratchet wrench 15 includes a pair of arcuate jaws 16, 17 at the end of an elongated handle 18. Jaw 16 is somewhat larger than jaw 17 and protrudes more markedly from handle 18 than does jaw 17 for purposes to be described. Jaws 16, 17 and handle 18 are defined by a pair of face plates 20, 22 (FIG. 2). A central plate 24 is sandwiched between face plates 20, 22 in handle 18 to provide space in jaws 16, 17 for a pair of elongated plates 26, 28 that are movably mounted to face plates 20, 22 within jaws 16, 17 in a manner described below. Plates 20, 22, 24 are secured together in handle 18 in any suitable way, such as by screws (not shown). The components of wrench 15 are made of tool steel or hardened steel for ruggedness.

One of the advantages of wrench 15 is its simple construction. Front and back plates 20, 22 are identical to each other, and elongated plates 26, 28 are also identically constructed. Thus, wrench 15 is easy to manufacture, and can easily be scaled up or down in size (i.e., enlarged or miniaturized with respect to standard-sized open-end wrenches).

As best shown in FIGS. 1 and 2, face plates 20, 22 extend longitudinally beyond the distal end 25 of central plate 24 to form a generally "C" shaped head 19 in which arcuate jaws 16, 17 are disposed. Jaws 16, 17 are laterally spaced from each other by any suitable amount to partially encircle a central opening 21 for receiving a workpiece (e.g., the head of a bolt, a nut, or an in-line fitting) by no more than 240 degrees. As a result, sufficient spacing S is provided between the tips and workpiece-engaging surfaces of plates 26, 28 to allow wrench 15 to be inserted onto the workpiece from the side rather than from above (or below) the workpiece.

Figure 4:
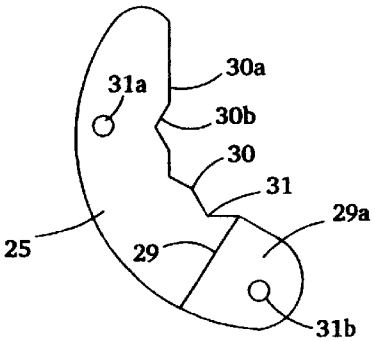
FIGS. 4 and 5 are plan and side views, respectively, of one of the plates shown in FIG. 2.
Figure 5:
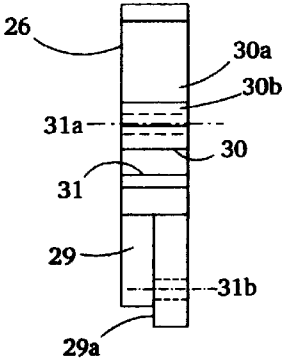

FIGS. 4 and 5 show elongated plate 26 separately from the remainder of wrench 15. As discussed, plates 26, 28 are identical, and thus plate 28 is not separately shown. Elongated plates 26, 28 are curved (more specifically, reniform, or kidney, shaped) and are slightly thinner than central plate 24 so that they may move easily between face plates 20, 22. The inner concave sides of elongated plates 26, 28 (i.e., the sides of plates 26, 28 that oppose each other) are notched to define a series of cusps 30, each of which is defined by a pair of flat surfaces 30*a*, 30*b*. Each plate 26, 28 includes three notches 31 defined by adjacent cusps 30 of the plate, and plates 26, 28 define another, central notch 31 at the junction between the plates. Elongated surfaces 30*a*, 30*b* that meet at a notch 31 are oriented at an angle that matches the angle defined by a pair of adjacent faces of the workpiece (which, for a hexagonal bolt head or nut, is 120 degrees).

Plates 26, 28 provide a total of sixteen surfaces 30*a*, 30*b* and eight cusps 30 arranged over an arc of 240 degrees (FIG. 1). As a result, the arrangement of surfaces 30*a*, 30*n* on plates 26, 28 corresponds to a so-called "12-point" design. (That is, if the plates were to be extended to define a 360 degree figure, they would provide twelve cusps 30 or "points," and twenty four surfaces 30*a*, 30*b*. The term "12-point" design is commonly used for socket wrenches to describe the number of "points" defined by the socket.)

The proximal ends of elongated plates 26, 28 are stepped-down in thickness at a shoulder 29 to define a shelf 29*a* at the base of each plate 26, 28. Shelves 29*a* are approximately one-half of the thickness of the remainder of each plate. A pair of round holes 31*a*, 31*b* are formed in each plate 26, 28, one (hole 31*a*) in the distal region of the plate, the other (31*b*) in shelf 29*a*. As discussed below, holes 31*a*, 31*b* receive pins that also pass through face plates 20, 22 for movably mounting elongated plates 26, 28 in wrench head 19.

Because of their identical shape, when plates 26, 28 are mounted within jaws 16, 17 with their elongated surfaces 30*a*, 30*b* facing each other, one plate (e.g., plate 26) will be face-up, and the other (plate 28) will be face-down. As a result, shelves 29*a* of the two plates will overlap with each other, with their holes 31*b* aligned in registry.

When elongated plates 26, 28 are in their rest position (shown by FIGS. 1 and 2), their elongated surfaces 30*a*, 30*b* extend into central opening 21 by an amount sufficient to engage and grasp the faces of a hexagonal workpiece when holding a hexagonal workpiece in the position shown in FIG. 3 or in a position rotated by 30 degrees from that shown in FIG. 3. Each elongated surface 30*a*, 30*b* is configured to engage a face of the workpiece over a major portion (such as at least 54%) of the length of the face. Elongated plates 26, 28 are restrained in their movement and held between face plates 20, 22 by three pins 32, 34, 36 which pass from face plate 20 to face plate 22 through respective slots 42, 44, 46 in face plates 20, 22 and round holes 31 in elongated plates 26, 28. Pins 32, 36 are secured within the distal holes 31*a* of respective plates 26, 28, while pin 34 is secured within the aligned proximal holes 31*b* of plates 26, 28. As discussed below, pin 34 is held sufficiently loosely within hole 31*b* of plate 26 to allow plate 26 to pivot about pin 34 during ratcheting.

Slots 42, 44, 46 in face plate 20 are identical to and are aligned in registry with corresponding slots 42, 44, 46 in face plate 22. Slots 42 are located in a distal region of jaw 17, slots 44 are positioned in a proximal base 23 of the jaws in wrench head 19, and slots 46 are located in a distal region of jaw 16. Slots 42, 44 are oriented along a common arc of curvature centered at the center C of workpiece W (FIG. 3). (Center C is also the center of wrench head 19.) Slot 46 comprises a pair of lobes 48, 50. Inner lobe 48 is oriented along the same arc of curvature as slots 42, 44. Slots 42, 44 and inner lobe 48 of slot 46 each define an arc length of 10–12 degrees.

Outer lobe 50 of slot 46 is transverse to, and extends radially outwardly from, lobe 48. In particular, outer lobe 50 extends along an arc centered at a point 45 (FIG. 1) that corresponds to the center of pin 34 when the pin is positioned on the opposite side of slot 44 (shown as pin 34' in dashed lines in FIG. 1). As explained below, pin position 34' corresponds to the "unlocked" or ratcheting position of elongated plates 26, 28. Outer lobe 50 extends from a distal end at the distal end of inner lobe 48, to a proximal end that is radially spaced from that of inner lobe 48, along an arc length of 9–10 degrees. As a result, the overall configuration of slot 46 is V-shaped. Jaw 16 is enlarged with respect to jaw 17 in the manner discussed above to provide room for V-shaped slot 46 without unduly weakening jaw 16.

A leaf spring 50 (FIG. 2) is placed in base 23 of head 19 at the end of handle 18. One end 52 of leaf spring 50 is captured within an angled (with respect to the central longitudinal axis of handle 18) groove 54 in central plate 24. The opposite end 56 of leaf spring 50 engages the curved outer surface 27 of plate 26, thereby biasing plate 26 inwardly towards the center C of wrench head 19 and against workpiece W (FIG. 3).

When wrench 15 is in the position shown in FIG. 3, pin 36 engages the proximal ends of inner lobes 48 of slots 46, pin 34 engages the inner (with respect to opening 21) surfaces of slots 44 at the right-most ends (as seen in FIG. 3) of slot 44, and pin 32 is located at the distal ends of slots 42. Elongated plates 26, 28 thus are in a "locked" position and are immobile relative to each other when wrench 15 is turned in a driving direction D (e.g., clockwise, as shown in FIG. 3).

The operation of the wrench is described in more detail below with reference to the embodiment of FIGS. 6–8. But briefly, after jaws 16, 17 are slid onto workpiece W from the side, wrench 15 is rotated in driving direction D to turn workpiece W. As handle 18 is turned in the driving direction, pressure develops between workpiece W and surfaces 30*a*, 30*b* of plates 26, 28. This pressure urges plates 26, 28 and pins 32, 36 outwardly and away from center C, and also urges the proximal ends of plates 26, 28 and pin 34 inwardly toward center C. These motions are prevented by the engagement of pins 32, 36 with the distal surfaces of slots 42, 46, and the engagement of pin against the inner and right-most end surfaces of slots 44. Accordingly, plates 26, 28 remain immobile with respect to each other in jaws 16, 17, grasp workpiece W between them at elongated surfaces 30*a*, 30*b*, and rotate workpiece W in driving direction D.

When handle 18 is turned in the opposite (e.g., counterclockwise) direction from arrow D, ratcheting occurs. That is, plates 26, 28 slide over the surface of the workpiece, allowing the workpiece to remain stationary. This operation is explained in detail below with respect to FIGS. 7 and 8. Briefly, however, when handle 18 is first rotated in the ratcheting direction, pins 32, 34 travel to an "unlocked" position at the opposite ends of respective slots 42, 44 along the common arc of curvature of the slots. That is, pins 34, 34 move to the proximal end of slot 42 and the left-most end of slot 44, respectively. Likewise, pin 36 moves within inner lobe 48 of slot 46 to the opposite (i.e., distal) end of lobe 48 (which also corresponds to one end of outer lobe 50, as discussed above). As a result, elongated plates 26, 28 rotate around center C with handle 18 until pins 32, 34, 36 reach the ends of slots 42, 44 and slot lobe 48, respectively. This operation requires approximately 10–12 degrees of handle rotation, which corresponds to the arc length of the slots.

With pins 32, 34, 36 positioned as just described, plates 26, 28 are "unlocked" and are ready for ratcheting. As handle 18 is rotated further counterclockwise (e.g. by 30 degrees for the 12-point configuration shown in FIG. 3), the engagement of plate 26 against workpiece W causes plate 26 to pivot outwardly from center C about centerpoint 45 (FIG. 1) of pin 34 as each corner of the workpiece slides across an elongated surface 30*a* or 30*b* of plate 26. Plate 28 remains stationary during the pivoting motion of plate 26. The pivoting motion of plate 26 is constrained by outer lobe 50 of slot 46. That is, pin 36 travels within outer lobe 50 as plate 26 pivots.

Leaf spring 50 biases plate inwardly toward center C. Thus, as the corners of the workpiece move toward notches 31, spring 50 urges plate 26 to pivot inwardly around centerpoint 45 of pin 34 in position 34', and back into full engagement with the workpiece surfaces. In the 12-point design shown in FIG. 3, approximately 30 degrees of handle rotation are needed to ratchet jaws 16, 17 around one corner of a hexagonal workpiece. Thus, handle 18 is rotated a total of approximately 40°–42° in the ratcheting direction before wrench 15 is again ready to turn workpiece W in the driving direction.

Because of the symmetrical construction of wrench 15, the driving and ratcheting direction can be reversed simply by turning wrench 15 over with respect to the workpiece (i.e., so that jaw 15 is on the right when viewed from above). In this orientation, the driving direction D is counterclockwise, and the ratcheting direction R is clockwise.

Other embodiments are within the scope of the following claims.

For example, the wrench may have elongated plates with more or fewer workpiece grasping surfaces.

Figures 6, 7, 8:
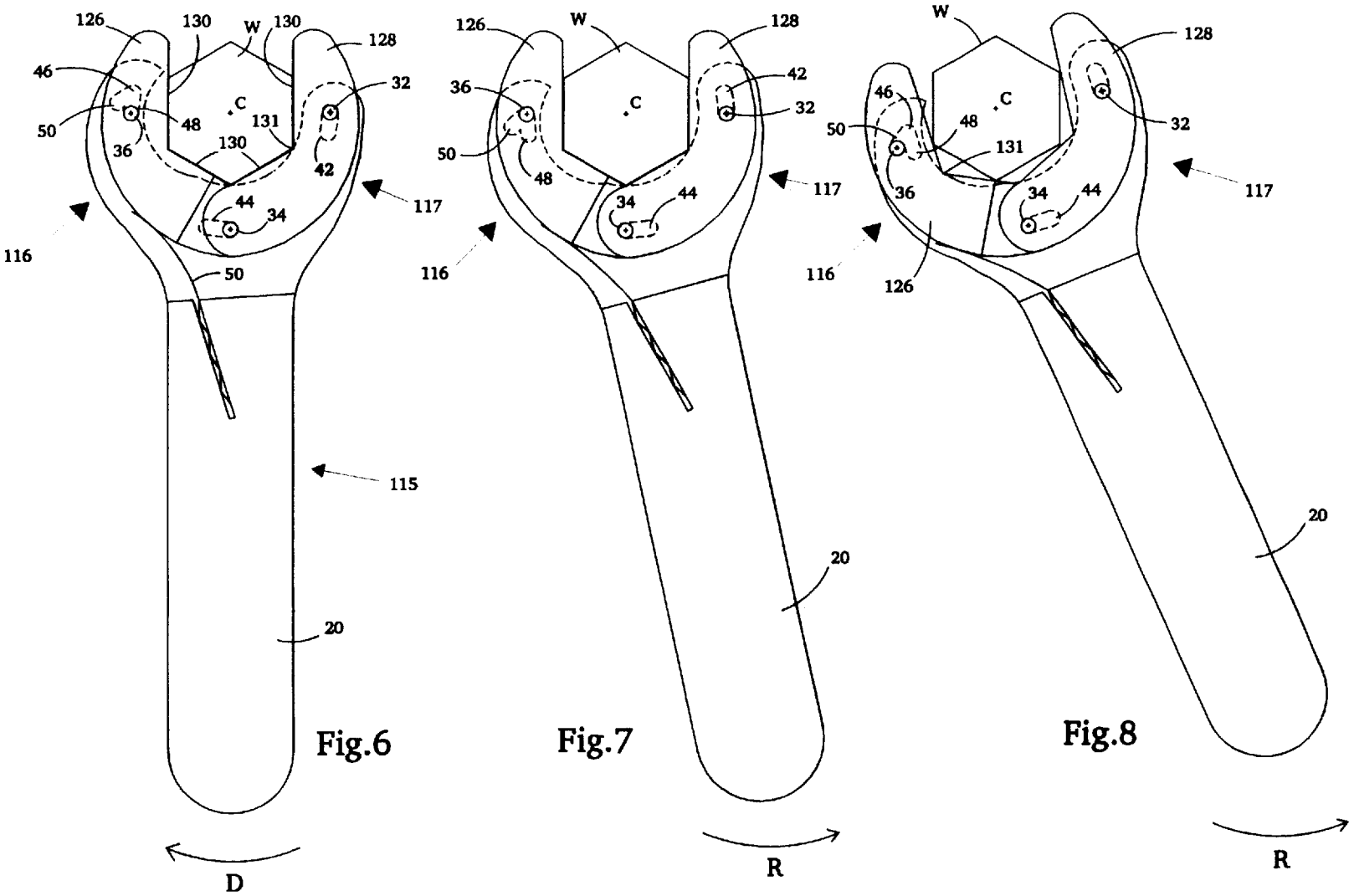
FIG. 6 illustrates another embodiment of the wrench being used to turn a workpiece in the driving direction (D).
FIGS. 7 and 8 show the operation of the wrench of FIGS. 6 in the non-driving (ratcheting) direction (R).

FIGS. 6–8 show a wrench 115 with so-called "16-point" design in which jaws 116, 117 respectively support elongated plates 126, 128 that each have two workpiece engaging surfaces 130*a*, 130*b*. Surfaces 130*a*, 130*b* are each sufficiently long to engage a face of workpiece W along the entire length of the face. Surfaces 130*a*, 130*b* define an angle of 120° and a notch 131 therebetween. In other respects, wrench 115 is identical to wrench 15, and thus the other components of wrench 115 have been given the same reference numerals as the corresponding components of wrench 15.

In operation, after wrench 115 is inserted onto workpiece W from the side, handle 20 is turned in a driving direction (D, FIG. 6) (e.g., clockwise) to rotate workpiece W. As discussed above for wrench 15, plates 126, 128 are in the "locked" position because of the position of pins 32, 34, 36 in respective slots 42, 44, 46. Thus, as handle 20 is turned in direction D, pressure develops between workpiece W and surfaces 130*a*, 130*b* of plates 126, 128. This pressure urges plates 126, 128 and pins 32, 36 outwardly and away from center C, and the proximal ends of plates 126, 128 and pin 34 inwardly toward center C. This motion is prevented by the engagement of pins 32, 36 against the distal and proximal ends, respectively, of slots 42, 46, as well as by the engagement of pin 34 against the inner and right-hand end (as viewed in FIG. 6) of slot 34. Accordingly, plates 126, 128 remain immobile with respect to each other in jaws 116, 117, grasp workpiece W therebetween, and turn the workpiece in response to the handle rotation.

Referring to FIG. 7, the ratcheting operation is performed by turning handle 20 in the opposite direction R (counterclockwise, in this example). As handle 20 is first moved in direction R, pressure develops between workpiece W and surfaces 130*a*, 130*b* of plates 126, 128. This force causes pins 32, 34, 36 to slide to the opposite ends of slots 42, 44 and inner lobe 48 of slot 46, respectively, thereby causing plates 126, 128 to rotate within jaws 116, 117 along the common arc of curvature of these slots. When pins 32, 34, 36 reach the opposite ends of the respective slots (which occurs after approximately 10°–12° of handle rotation), elongated plates 126, 128 are in the "unlocked" position for ratcheting.

Referring to FIG. 8, further rotation of handle 20 in direction R around workpiece W causes additional pressure to be exerted against plates 126, 128 by workpiece W. This pressure causes plate 126 to pivot about pin 34 outwardly with respect to the workpiece and the remainder of jaw 116. This motion is constrained by pin 36, which travels in outer lobe 50 of slot 46. As a result, elongated surfaces 130*a*, 130*b* of plates 126, 128 slide around the corners of workpiece W, allowing the workpiece to remain stationary.

Once jaws 116, 118 have been rotated approximately 60° to a new ratcheting position (i.e., as a corner of the workpiece W slides into an adjacent notch 131), biasing spring 50 urges plate 126 to pivot inwardly about pin 34 so that pin 36 travels to its unlocked position at the distal end of lobes 48, 50. If further ratcheting is desired, the user continues to rotate handle 20 in direction R. Otherwise, the user resumes rotating handle 20 in driving direction D. For the initial 10°–12° of rotation in direction D, plates 126, 128 will not turn the workpiece but will instead rotate to their "locked" position as pins 32, 34, 36 move to the ends of the slots as shown in FIG. 6. Thereafter, further rotation of handle in the driving (e.g., clockwise) direction will cause plates 126, 128 to grasp and turn the workpiece.

Still other embodiments are within the scope of the claims.

For example, the positions of the distal pins and slots may be reversed. That is, referring to FIG. 3, pins 32, 36 may be formed in the face plates, and slots 42, 46 defined in the distal regions of plates 26, 28.

The elongated surfaces of the movable plates may be curved (e.g., convex with respect to opening 21) rather than flat. Other numbers and angular arrangements of elongates surfaces may be used.

The wrench handle need not be in-line with, or in the same plane as, the jaws, as is shown in the figures. Instead, as is typical with open-end wrenches, the handle may be offset at an acute angle to the jaws, either in the plane of the jaws, or out of the plane of the jaws, or both. The groove for the biasing spring may be parallel to the handle axis; indeed, the spring may be fixed to the handle in other ways.

What is claimed is:

1. A wrench comprising a pair of jaws disposed on a handle, the jaws being spaced to define an opening for a workpiece, a first one of said jaws having an elongated hole disposed therein, a pair of plates respectively mounted on the jaws, each of the plates including a workpiece engaging surface adjacent the opening, and a pin mounted on a first one of the plates, the pin and the hole being arranged to enable selective relative movement of the plates between:

a) a first position in which the pin is not disposed in the hole and the plates are immobile with respect to each other so that rotation of the handle in a first direction causes the plates to grasp the workpiece between the engaging surfaces and turn the workpiece in the first direction, and b) and a second position in which the pin is positioned in the hole and the first plate is pivotable with respect to a second one of the plates in a direction defined by the elongated hole so that rotation of the handle in a second, opposite direction causes pivoting of the first plate and allows the engaging surfaces to slide over the workpiece, thereby allowing the workpiece to remain stationary.

2. The wrench of claim 1 wherein the plates are mounted for the selective movement in response to rotation of the handle.

3. The wrench of claim 1 in which the first plate has a proximal end and a distal end, the first plate being mounted to a first one of the jaws so that the distal end is immobile in the first position, and is pivotable with respect to the second plate in the second position.

4. The wrench of claim 3 wherein the pin is a distal pin mounted on the distal end of the first plate, and further comprising a slot disposed in a distal region of the first jaw, the distal pin being disposed in a first portion of the distal slot when the plate is in the first position, said hole comprising a second portion of the distal slot in which said distal pin is disposed when the plate is in the second position.

5. The wrench of claim 4 wherein the first portion of the distal slot is oriented so that the engagement of the distal pin therein holds the distal end of the first plate immobile with respect to the second plate when the wrench is rotated in the first direction, and the second portion of the distal slot is oriented to allow the distal end of the first plate to pivot with respect to the second plate in the defined direction when the wrench is rotated in the second direction.

6. The wrench of claim 5 further comprising a proximal pin on the proximal end of the first plate received by a slot disposed in a proximal region of the first jaw, the proximal slot and the first portion of the distal slot being oriented to allow the selective movement of the first plate between the first position and the second position.

7. The wrench of claim 6 wherein the proximal slot and the first portion of the distal slot are oriented along a common arc of curvature having a center disposed in the opening, and the second portion of the distal slot is arranged transversely to the arc of curvature.

8. The wrench of claim 6 further comprising a distal pin at a distal end of the second plate received by a slot disposed in a distal region of the second jaw, and a proximal pin on a proximal end of the second plate received by the proximal slot, the proximal slot and the distal slot being oriented to allow the selective movement of the second plate between the first position and the second position.

9. The wrench of claim 1 further comprising a spring positioned to bias the first plate toward the opening.

10. The wrench of claim 9 wherein the plates and the spring are arranged so that turning the wrench over with respect to the workpiece reverses operation of the wrench in the first and second directions.

11. The wrench of claim 1 wherein each of the plates has a plurality of the engaging surfaces.

12. The wrench of claim 11 wherein each of the engaging surfaces is elongated so as to engage a face of the workpiece over a major portion of a length of the face.

13. The wrench of claim 11 wherein said engaging surfaces are flat.

14. The wrench of claim 11 wherein the engaging surfaces are arranged to define an angle therebetween equal to an angle between adjacent faces of the workpiece.

15. A wrench comprising a pair of jaws disposed on a handle, the jaws being spaced to define an opening for a workpiece, and a pair of identically configured plates each of which includes a workpiece engaging surface adjacent the opening, the plates being mounted on the jaws for selective movement between:

a) a first position in which the plates are immobile with respect to each other so that rotation of the handle in a first direction causes the plates to grasp the workpiece between the engaging surfaces and turn the workpiece in the first direction, and b) and a second position in which a first one of the plates is pivotable with respect to a second one of the plates so that rotation of the handle in a second, opposite direction causes pivoting of the first plate and allows the engaging surfaces to slide over the workpiece, thereby allowing the workpiece to remain stationary.

16. A wrench comprising first and second jaws disposed on a handle, the jaws being spaced to define an opening for a workpiece, each of the jaws having a distal slot disposed in a distal region thereof, first and second plates each of which includes a workpiece engaging surface adjacent the opening, a pair of distal pins each of which is mounted to one of the plates and received in a corresponding one of the distal slots, and a proximal pin mounted to the first and second plates and received in a proximal slot disposed in a proximal region of the jaws, the slots being arranged to allow selective movement of the plates between:

a) a first position in which the pins are positioned in the slots to hold the plates immobile with respect to each other so that rotation of the handle in a first direction causes the plates to grasp the workpiece between the engaging surfaces and turn the workpiece in the first direction, and b) and a second position in which the pins are positioned in the slots so that the first plate is pivotable with respect to the second plate so that rotation of the handle in a second, opposite direction causes pivoting of the first plate and allows the engaging surfaces to slide over the workpiece, thereby allowing the workpiece to remain stationary; and a spring positioned to bias the first plate toward the opening.

17. The wrench of claim 16 wherein the distal slot of the first jaw has a first portion and a second portion, the first portion being oriented so that the engagement of the corresponding pin therein holds the distal end of the first plate immobile with respect to the second plate when the wrench is rotated in the first direction, and the second portion being oriented to allow the distal end of the first plate to pivot with respect to the second plate when the wrench is rotated in the second direction.

18. The wrench of claim 17 wherein the proximal slot, the first region of the distal slot of the first jaw, and the distal slot of the second jaw are oriented along a common arc of curvature having a center disposed in the opening, and the second portion of the distal slot is arranged transversely to the arc of curvature.

19. The wrench of claim 16 wherein the plates and the spring are arranged so that turning the wrench over with respect to the workpiece reverses operation of the wrench in the first and second directions.

20. The wrench of claim 16 wherein the plates are identically configured.

21. A method for operating on a workpiece comprising providing a wrench comprising: a pair of jaws disposed on a handle, the jaws being spaced to define an opening for the worlkpiece, a first one of the jaws having an elongated hole disposed therein; a pair of plates respectively mounted on the jaws, each of the plates including a workpiece engaging surface adjacent the opening; and a pin mounted on a first one of the plates, engaging the wrench with the workpiece, disposing the plates in a first position in which the pin is not disposed in the hole and the plates are immobile with respect to each other, and rotating the handle in a first direction so that the plates grasp the workpiece between the engaging surfaces and turn the workpiece in the first direction, and disposing the plates in a second position in which the pin is positioned in the hole so that the first plate is pivotable with respect to a second one of the plates, and rotating the handle in a second, opposite direction to cause the first plate to pivot in a direction defined by the elongated hole so that the engaging surfaces slide over the workpiece, thereby allowing the workpiece to remain stationary.

* * * * *

UNITED STATES PATENT AND TRADEMARK OFFICE

CERTIFICATE OF CORRECTION

PATENT NO. : 6,223,630 B1
DATED : May 1, 2001
INVENTOR(S) : John L. Stanton, M.D.

It is certified that error appears in the above-identified patent and that said Letters Patent is hereby corrected as shown below:

Column 6,
Line 55, replace "16-point" with -- 6-point --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*